US009701462B2

(12) United States Patent
Hyp et al.

(10) Patent No.: US 9,701,462 B2
(45) Date of Patent: Jul. 11, 2017

(54) NESTABLE CARTON FOR WHEELBARROW KIT

(75) Inventors: Eric D. Hyp, Hanover, PA (US); William J. Logan, Elizabethtown, PA (US)

(73) Assignee: The Ames Companies, Inc., Camp Hill, PA (US)

( * ) Notice: Subject to any disclaimer, the term of this patent is extended or adjusted under 35 U.S.C. 154(b) by 2230 days.

(21) Appl. No.: 11/505,503

(22) Filed: Aug. 17, 2006

(65) Prior Publication Data

US 2008/0041740 A1 Feb. 21, 2008

(51) Int. Cl.

| | |
|---|---|
| ***B65D 71/00*** | (2006.01) |
| ***A45C 11/26*** | (2006.01) |
| ***B65D 85/62*** | (2006.01) |
| ***B65D 75/14*** | (2006.01) |
| *B25H 3/02* | (2006.01) |
| *B65D 21/02* | (2006.01) |

(52) U.S. Cl.

CPC ..... *B65D 85/62* (2013.01); *B65D 75/14* (2013.01); *B25H 3/02* (2013.01); *B65D 21/0209* (2013.01); *B65D 2585/649* (2013.01)

(58) Field of Classification Search

CPC .... B65D 71/00; B65D 85/62; B65D 21/0209; B65H 3/02

USPC ..... 206/499, 525, 320, 321, 223, 349, 738, 206/746, 774, 503, 505, 506, 507

See application file for complete search history.

(56) References Cited

U.S. PATENT DOCUMENTS

| | | | | |
|---|---|---|---|---|
| 1,059,359 | A * | 4/1913 | Hahn | 217/26 |
| 1,116,694 | A * | 11/1914 | Hahn | 217/27 |
| 1,146,515 | A * | 7/1915 | Potter | 206/500 |
| 1,625,620 | A * | 4/1927 | Maston | 217/27 |
| 2,796,979 | A | 6/1957 | Buttery | |
| 3,235,281 | A | 2/1966 | Faucette, Jr. | |
| 3,315,875 | A * | 4/1967 | Praetorius | 229/242 |
| 3,620,364 | A * | 11/1971 | Lynch | 206/577 |
| 4,991,716 | A | 2/1991 | Havlovitz | |
| 5,429,232 | A * | 7/1995 | Orr et al. | 206/320 |
| 5,522,502 | A | 6/1996 | Orr et al. | |
| 5,826,728 | A * | 10/1998 | Sheffer | 206/774 |
| 5,957,294 | A * | 9/1999 | Kanter | 206/774 |
| 6,422,390 | B1 * | 7/2002 | Humphrey | 206/500 |
| 7,066,333 | B2 * | 6/2006 | Justice | 206/738 |

(Continued)

FOREIGN PATENT DOCUMENTS

FR 2 511 978 3/1983

*Primary Examiner* — Andrew Perreault

(74) *Attorney, Agent, or Firm* — Kristin L. Murphy; Brooks Kushman P.C.

(57) ABSTRACT

A carton for a wheelbarrow kit having a hopper with rim portion and a tapered bucket portion, the carton structured to enclose the rim portion of the hopper and having a first opening allowing the bucket portion of the hopper to extend out of the carton. The carton further provides a second opening generally aligned with the first opening, but disposed on the side of the carton opposed to the first opening. The hopper is inverted in the carton so that the rim is disposed at the bottom of the carton and the hopper extends upwardly. In this configuration, multiple cartons enclosing wheelbarrow kits may be stacked on top of each other with the hopper of a lower carton extending upwardly through the second opening of the adjacent carton and into the partially enclosed space of the hopper in the carton above.

14 Claims, 4 Drawing Sheets

(56) References Cited

U.S. PATENT DOCUMENTS

| | | | | |
|---|---|---|---|---|
| 2003/0146130 | A1* | 8/2003 | Kanter et al. | 206/774 |
| 2005/0072704 | A1* | 4/2005 | Patz et al. | 206/418 |

* cited by examiner

NESTABLE CARTON FOR WHEELBARROW KIT

BACKGROUND OF THE INVENTION

Field of the Invention

This invention relates to cartons and, more specifically, to a nestable carton system for packaged wheelbarrow kits.

Background Information

Wheelbarrows are well known in the art. A wheelbarrow, typically, includes a hopper, a frame assembly, a wheel, and a plurality of fasteners and/or coupling devices. The hopper defines a partially enclosed space and, typically, has a base plate with an upwardly extending sidewall. The sidewall is also commonly angled outwardly from the base plate. Typically, the upper edge of the sidewall forms a rim that, when the wheelbarrow is at rest, extends in a generally horizontal plane. The lower portion of the sidewall and the base plate form a "bucket" structured to contain various materials, e.g. fluids or granulate materials, or other objects, e.g. bricks, leaves, etc. The base plate is typically planar and, when the wheelbarrow is at rest, disposed at an angle ascending from front to rear. Thus, to have a generally horizontal rim, the front portion of the sidewall is, typically, taller than the rear portion of the sidewall. In this configuration, the hopper had an overall wedge-like shape.

While this configuration is efficient during use, a wheelbarrow cannot typically be packaged for shipping and display in a similarly efficient manner. That is, prior to assembly and use, the components of a wheelbarrow must be protectively packaged and shipped as a wheelbarrow kit. However, because a hopper is generally hollow and typically is structured to hold up to 55 gallons of fluid, a carton or other package designed to enclose the hopper is also enclosing a significant volume of empty space. Further, the size of the carton is also affected by the size and shape of the frame assembly. That is, the frame assembly, typically, includes two elongated handles that have a greater length than the hopper. The carton must also be structured to enclose the elongated handle members. Such large cartons are expensive.

One solution to minimizing the size of a wheelbarrow carton was to provide sectional handle members that were later assembled into the elongated handles. Such handles, along with other frame assembly elements and other wheelbarrow components were placed in a box or other device and disposed in the hopper. In this configuration, the carton was designed to generally conform to the shape of the hopper which, as noted above, is a wedge-like shape. This design, however, also had disadvantages. For example, a wedge-like carton was not easily stackable. Also, as the handle members are used to lift the wheelbarrow, it is generally more desirable to have stronger, unitary handle members. Further, while such cartons could be smaller than prior packaging, the cartons still were required to enclose a substantially empty space.

Accordingly, there is a need for a carton for a wheelbarrow kit structured to minimize the amount of carton material, and therefore expense, while providing adequate protection for the components of the wheelbarrow kit, including the hopper.

There is a further need for a carton for a wheelbarrow kit that is stackable.

There is a further need for a carton for a wheelbarrow kit that does not enclose a substantially empty space.

There is a further need for a carton system for wheelbarrows that allows multiple cartons to be shipped efficiently.

SUMMARY OF THE INVENTION

These needs, and others, are met by at least one embodiment of the disclosed invention which provides a carton having generally rectangular, generally planar sides structured to enclose the rim portion of a hopper and having a first opening allowing the bucket portion of the hopper to extend out of the carton. The carton further provides a second opening generally aligned with the first opening, but disposed on the side of the carton opposed to the first opening. The carton is also thin. That is, the depth of the carton is substantially less than the length and/or width of the carton. Preferably, the hopper is inverted in the carton so that the rim is disposed at the bottom of the carton and the hopper extends upwardly. Also, as the hopper sidewall is angled outwardly from the base plate, the hopper has a tapered cross-sectional shape wherein the rim portion has a greater cross-sectional area than the bucket portion. In this configuration, multiple cartons enclosing wheelbarrow kits may be stacked on top of each other with the hopper of a lower carton extending upwardly through the second opening of the adjacent carton and into the partially enclosed space of the hopper in the carton above. That is, the bucket portion of each hopper extends out of one carton through the enclosed space of the carton above and into the bucket of the wheelbarrow in the carton above. In this configuration, the partially enclosed space defined by each hopper (except the bottommost hopper) is partially filled by one or more hoppers enclosed in other cartons.

The uppermost carton in a stack may include a protective barrier disposed over the exposed hopper extending therefrom. Alternatively, the carton system may include an outer carton structured to enclose the wheelbarrow carton stack. The outer carton, preferably, has an extended upper space structured to enclose the uppermost hopper. Further, the outer carton is structured to align the wheelbarrow carton stack so that the wheelbarrow cartons do not shift relative to each other and, possibly, allow separate hoppers to contact each other.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, an opening that "conforms to the shape" of another component has the same cross-sectional shape as the component, but is slightly larger so that the opening allows the component to pass therethrough while engaging the component in a snug manner.

Figure 1:
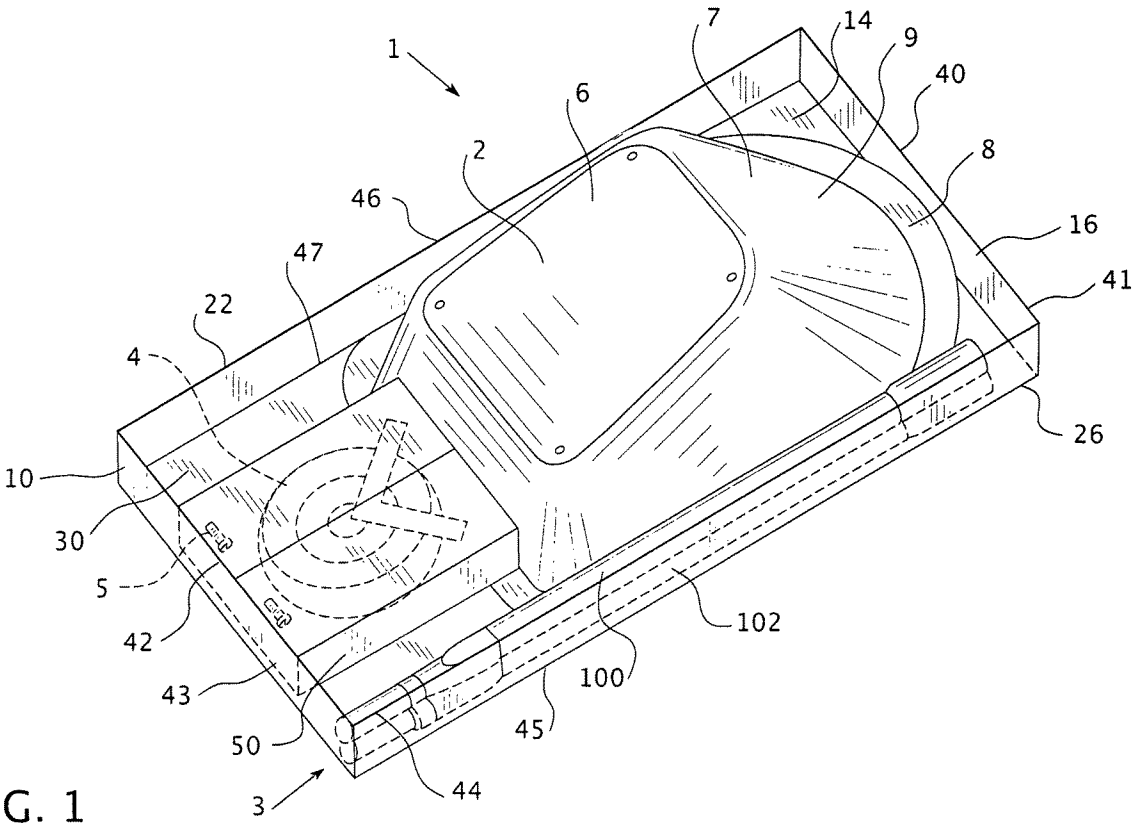
FIG. 1 is an isometric cut away view of a wheelbarrow kit disposed in a carton.

As shown in FIG. 1 a wheelbarrow kit 1 includes a hopper 2, a frame assembly 3 having elongated handles 100, 102, a wheel 4, and a plurality of coupling devices 5 (shown schematically). The hopper 2, shown inverted, includes a base plate 6 and a depending sidewall 7. The sidewall 7 has an upper rim portion 8 that is generally planar. The base plate 6 is disposed at an angle relative to the plane of the hopper rim portion 8. Thus, the front portion of the sidewall 7 is longer than the rear portion of the sidewall 7. Further, the sidewall 7 is angled outwardly relative to the base plate 6. Thus, the portion of the sidewall 7 below the rim portion 8 forms a generally tapered bucket portion 9 having a wider cross-sectional area adjacent to the hopper rim portion 8 and a narrower cross-sectional area adjacent to the base plate 6.

A carton 10 is structured to enclose substantially all of the wheelbarrow kit 1, except for the hopper bucket portion 9. That is, the carton 10 includes a first generally planar member 12, a second generally planar member 14, and a sidewall 16. The first planar member 12 has a first opening 20 and a perimeter 22. The second planar member 14 has a second opening 24 (FIG. 3) and a perimeter 26. The sidewall 16 extends from the first planar member perimeter 22 to the second planar member perimeter 26. In this configuration, the first planar member 12, the second planar member 14, and the sidewall 16 define an enclosed carton space 30. The enclosed carton space 30 is sized to enclose the hopper rim portion 8 as well as other elements of the kit 1, as described below. The first opening 20 and the second opening 24 are each sized to allow a hopper bucket portion 9 to pass therethrough, as described in more detail below. In this configuration, a hopper 2 may be disposed with the hopper rim portion 8 within the enclosed carton space 30 and with the hopper bucket portion 9 extending through the first opening 20.

Figure 2:
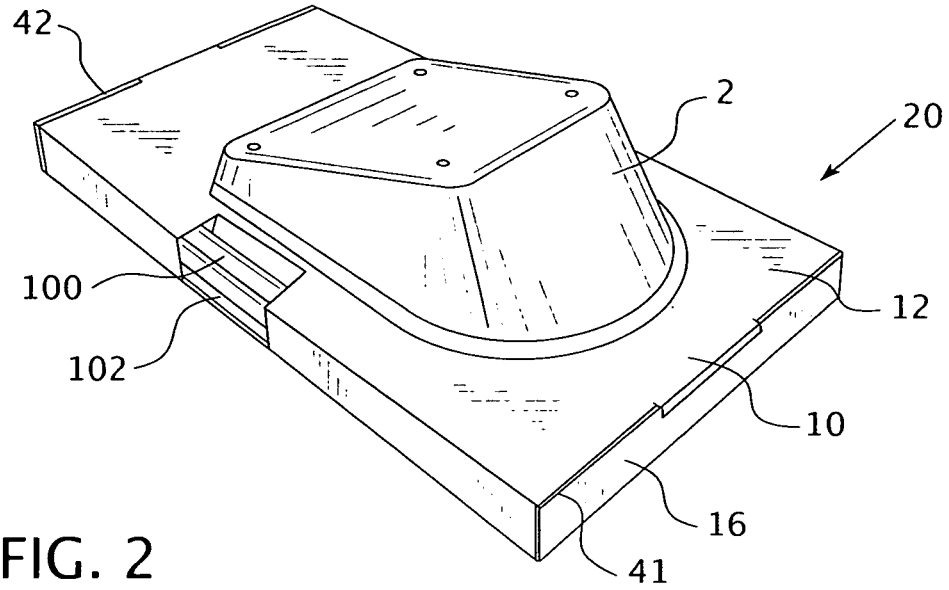
FIG. 2 is an isometric view of a wheelbarrow kit in a carton.

As shown in FIG. 2, the hopper 2 is preferably disposed in the carton 10 in an inverted orientation. That is, the hopper rim portion 8 is preferably disposed on the interior side of the second planar member 14. In this orientation, the hopper bucket portion 9 passes upwardly through the first opening 20. The first opening 20 conforms to the shape of the hopper bucket portion 9. The second opening 24 (FIG. 3) also conforms to the shape of a hopper bucket portion 9, but, as described below, the second opening 24 may be slightly smaller than the first opening 20 as the second opening 24 is structured to engage a hopper bucket portion 9 of a hopper 2 disposed in another carton 10.

In the preferred embodiment, the first planar member 12 and the second planar member 14 each have a generally rectangular shape. That is, the first planar member 12 and the second planar member 14 each have a front edge 40, 41 (respectively) and a rear edge 42, 43 (respectively) which extend generally parallel to each other. Further, the first planar member 12 and the second planar member 14 each have a first lateral edge 44, 45 (respectively) and a second lateral edge 46, 47 (respectively) which extend generally parallel to each other and generally perpendicular to the front edges 40, 41 and the rear edges 42, 43. The size of the first planar member 12 and the second planar member 14 depend upon the size of the wheelbarrow packaged within the carton 10. For example, for a small toy-like wheelbarrow having a 6 gallon hopper 2, the first planar member 12 and the second planar member 14 have a length of between about 28 and 36 inches, and more preferably about 32.5 inches and a width of between about 15 and 21 inches, and more preferably about 17.25 inches. The sidewall 16 has a height of between about 2.5 and 5 inches, and more preferably about 3.15 inches. Thus, the carton 10 is generally a thin, flat container. For larger wheelbarrows, the size of the carton 10 may be increased, but the dimensions will remain proportional. That is, the carton 10 will always be a generally longer and wider than it is deep, regardless of the size of the wheelbarrow.

In the preferred embodiment, the carton 10 is structured to enclose the wheel 4 and coupling devices 5 as well as, substantially enclose the wheelbarrow handles 100, 102. That is, the smaller components of the wheelbarrow kit 1, e.g., the wheel 4 and coupling devices 5 may be disposed in a container(s) 50 such as, but not limited to, a box 52 or a bag (not shown). The container(s) 50 are sized to fit within the enclosed carton space 30, preferably immediately adjacent to the rear side of the hopper 2. The wheelbarrow handles 100, 102, which are preferably elongated and have a greater length than the hopper 2, are disposed within the enclosed carton space 30, preferably immediately adjacent to a lateral side of the hopper 2.

Figure 3:
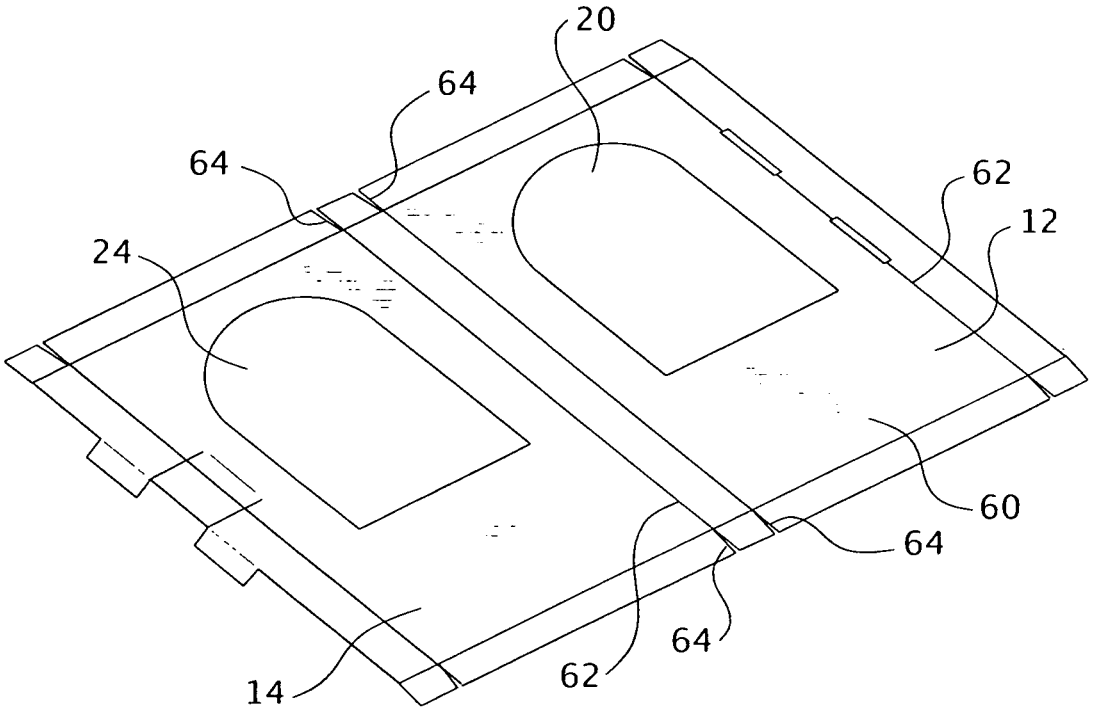
FIG. 3 is an isometric view of the flat that is folded to become a carton.

As shown in FIG. 3, the first planar member 12, the second planar member 14 and the sidewall 16 are, preferably, formed from a single planar sheet of corrugated material or blank 60 which is folded to define the enclosed carton space 30. As is known in the art, the blank 60 includes a plurality of fold lines 62 and cuts 64 which allow the single blank to be folded into the desired shape. That is, the fold lines 62 define the edges of the first planar member 12, the second planar member 14 and certain edges of the sidewall 16. Additionally, the blank 60 includes a number of slots 66 and tabs 68 which act as a coupling device 5. When the blank 60 is folded into the proper shape, each tab 68 is aligned with, and may be inserted into a slot 66. Alternatively, the carton 10 may be made from two or more sheets of a material, preferably a corrugated material, wherein the various sections are coupled together by one or more coupling devices 5 such as, but not limited to, glue, staples, or tape.

The carton 10 is, preferably, incorporated into a carton system 70 having at least two cartons, a first carton 10A and a second carton 10B, and may have an outer carton 72. The cartons 10A, 10B are as described and are distinguished from each other by the letters "A" and "B." Similarly, the components or elements of the cartons 10A, 10B shall be identified by the letters "A" and "B." For example, the first carton 10A has a first carton first planar member 12A and the second carton 10B has a second carton first planar member 12B.

Figure 4:
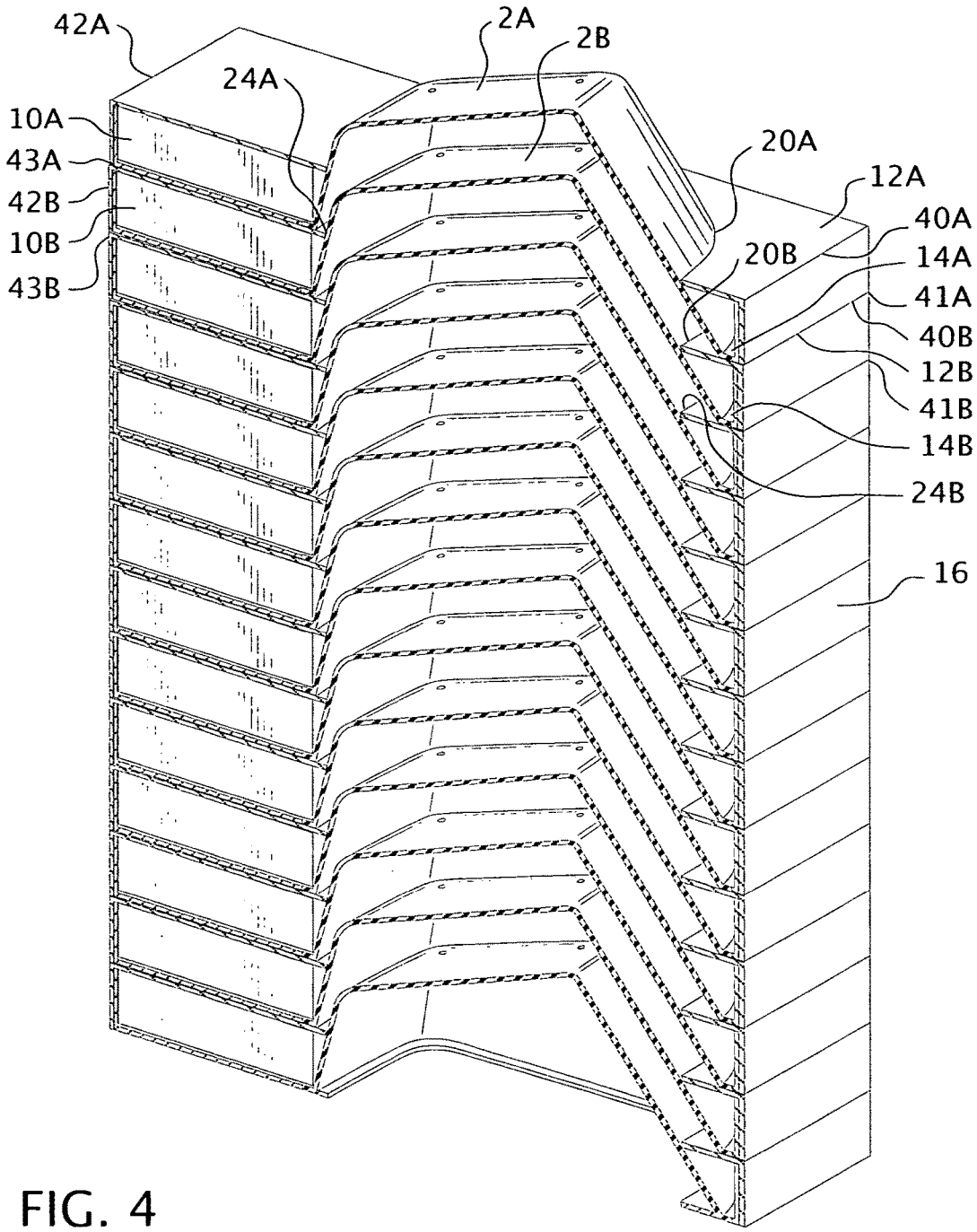
FIG. 4 is a cross-sectional isometric view of a wheelbarrow carton stack.

The cartons 10A, 10B are structured to enclose separate wheelbarrow kits, a first wheelbarrow kit 1A and a second wheelbarrow kit 1B, each having hoppers 2A, 2B. The first carton 10A encloses the first hopper 2A with the first hopper bucket portion 9A extending upwardly through the first carton first opening 20A. The second carton 10B encloses the second hopper 2B with the second hopper bucket portion 9B extending upwardly through the second carton first opening 20B. As shown in FIG. 4, the first carton 10A is disposed above, and generally aligned with, the second carton 10B. That is, the first carton 10A is stacked on the second carton 10B with the first carton second planar member 14A disposed against the second carton first planar member 12B. Thus, the second hopper bucket portion 9B also extends upwardly through the first carton second opening 24A. The first carton second opening 24A conforms to the shape of the second hopper bucket portion 9B. As the second hopper bucket portion 9B is tapered, as discussed above, the cross-sectional area of the second hopper bucket portion 9B at the location of the first carton second opening 24A is slightly smaller than the cross-sectional area of the second hopper bucket portion 9B at the location of the second carton first opening 20B. Accordingly, the first carton second opening 24A may be slightly smaller, that is, have a smaller cross-sectional area, than the second carton first opening 20B.

By having the first carton second opening 24A conform to the shape of the second hopper bucket portion 9B, the first carton 10A is maintained in alignment with the second carton 10B. That is, by having the first carton second opening 24A fit snugly against the second hopper bucket portion 9B, the first carton 10A resists sliding longitudinally or laterally relative to the second carton 10B. When the cartons 10A, 10B are aligned, the hoppers 2A, 2B are spaced from each other and are less likely to impact upon each other.

Figure 5:
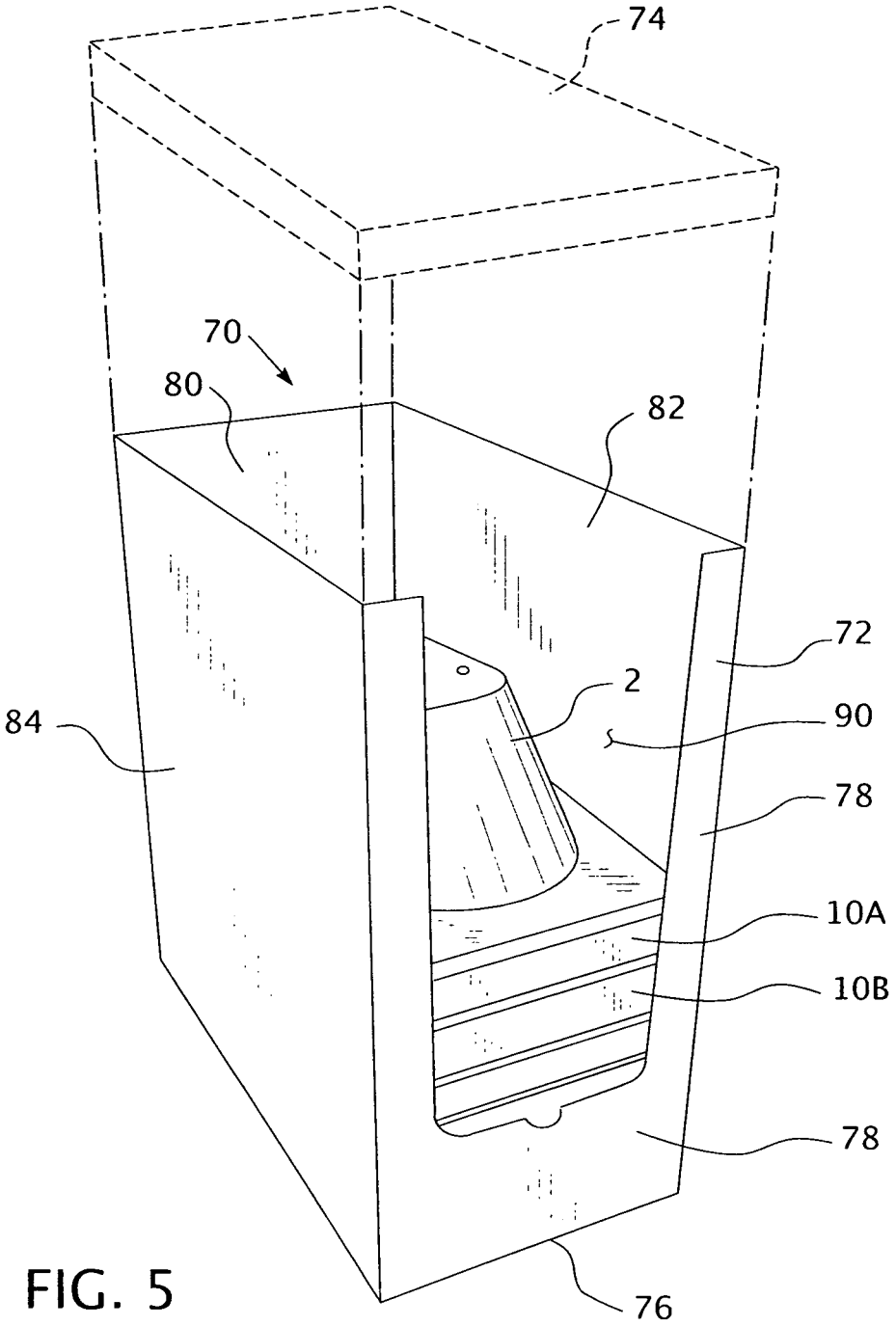
FIG. 5 is an isometric view of a wheelbarrow carton stack with an outer carton.

To further ensure that the cartons 10A, 10B are aligned, the carton system 70 may include the outer carton 72. As shown in FIG. 5, the outer carton 72 has a generally rectangular top planar member 74 (shown in ghost), a generally rectangular bottom planar member 76, a front planar member 78, a rear planar member 80, a first lateral planar member 82 and a second lateral planar member 84. The outer carton top planar member 74 and the outer carton bottom planar member 76 are disposed generally parallel to each other. The front planar member 78, the rear planar member 80, the first lateral planar member 82 and the second lateral planar member 82 extend between, and generally perpendicular to, the top planar member 74 and the bottom planar member 76. The outer carton top planar member 74 and the outer carton bottom planar member 76 have a slightly larger cross-sectional area than the first carton first planar member 12A, the first carton second planar member 14A, the second carton first planar member 12B, and the second carton second planar member 14B. Thus, the cartons 10A, 10B may be disposed within the outer carton 72. While the cartons 10A, 10B are disposed within the outer carton 72, the outer carton front planar member 78 contacts the first carton and second carton front edges 40A, 41A, 40B, 41B and the outer carton rear planar member 80 contacts the first carton and second carton rear edges 42A, 43A, 42B, 43B. Thus, because the outer carton front planar member 78 and outer carton rear planar member 80 are generally planar, the first carton first planar member front edge 40A and the second carton first planar member front edge 40B are generally disposed in the same plane. In this configuration, the outer carton 72 maintains the alignment of the cartons 10A, 10B.

The outer carton 72 may also be structured to be a display. That is, the outer carton 72 may have a removable top planar member 74 and a removable portion 90 on the front planar member 78. Thus, as shown in FIG. 5, when the first carton 10A and the second carton 10B are disposed in the outer carton 72 and when the outer carton top planar member 74 and the front planar member removable portion 90 are removed, the first carton 10A and the second carton 10B are visible within said outer carton 72.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A carton for a first wheelbarrow kit, said wheelbarrow kit having a hopper, a wheel, a frame assembly, and coupling device, said hopper having a generally planar rim portion and a bucket portion, said bucket portion extending out of the plane of said rim portion, said bucket portion being generally tapered, said carton structured to be stacked on a similar carton enclosing second wheelbarrow kit and to engage the hopper from the second wheelbarrow kit, said carton comprising:

a first generally planar member having a first opening and a perimeter;

a second generally planar member having a second opening and a perimeter;

a sidewall extending from said first planar member perimeter to said second planar member perimeter;

wherein said first planar member, said second planar member, and said sidewall define an enclosed carton space;

wherein said enclosed space is so dimensioned to allow a first wheelbarrow kit hopper to be disposed therein with said hopper rim portion within said enclosed space and with said first wheelbarrow kit hopper bucket portion extending through said first opening said first opening is so dimensioned to conform to the shape of a hopper bucket portion disposed in said enclosed space and at said first planar member; and said second opening is so dimensioned to conform to the shape of a second wheelbarrow kit hopper bucket portion located in another carton disposed below said carton and at said second planar member.

2. The carton of claim 1 wherein said first planar member, said second planar member and said sidewall are formed from a single planar sheet of corrugated material which is folded to define said enclosed carton space.

3. A carton system for stacking a plurality of wheelbarrow kits in a nested manner, each said wheelbarrow kit having a hopper, a wheel, a frame assembly, and coupling device, said hopper having a generally planar rim portion and a bucket portion, said bucket portion extending out of the plane of said rim portion, said bucket portion having a bottom, said bucket portion being tapered from a wide cross-sectional area at said rim portion to a narrower cross-sectional area adjacent to said bottom, said carton system comprising:

a first carton and a second carton each comprising:

a first generally planar member having a first opening and a perimeter;

a second generally planar member having a second opening and a perimeter;

a sidewall extending from said first planar member perimeter to said second planar member perimeter;

wherein said first planar member, said second planar member, and said sidewall define an enclosed space;

wherein said first carton is so dimensioned so that when a first hopper is disposed within said first carton, said first hopper rim portion will be disposed within said first carton enclosed space and with said first hopper bucket portion extending through said first carton first opening;

wherein said second carton is so dimensioned so that when a second hopper is disposed within said second carton, said second hopper rim portion will be disposed within said second carton enclosed space and with said second hopper bucket portion extending through said second carton first opening; and wherein when said first carton is stacked on said second carton, said second hopper bucket portion extends through said first carton second opening;

wherein each said first opening is so dimensioned to conform to the shape of said hopper bucket portion disposed within the associated enclosed space and at said first planar member; and wherein each said second opening is so dimensioned to conform to the shape of said hopper bucket portion disposed in a lower carton and at said second planar member.

4. The carton system of claim 3 wherein:

said first carton first planar member, said first carton second planar member and said first carton sidewall are formed from a single planar sheet of corrugated material; and said second carton first planar member, said second carton second planar member and said second carton sidewall are formed from a single planar sheet of corrugated material.

5. The carton system of claim 4 wherein each said frame assembly includes two elongated handle members, said handles having a length greater than a hopper, and wherein:

said first carton and said second carton enclosed space are each sized to enclose a pair of said wheelbarrow handle members, a wheel, a frame assembly and a set of coupling devices; and said first carton and said second carton enclosed space is so dimensioned to allow said a pair of handle members to be disposed immediately adjacent to a hopper rim portion.

6. The carton system of claim 3 wherein:

said first carton sidewall has a height of between about 2.5 inches and 5.0 inches; and said second carton sidewall has a height of between about 2.5 inches and 5.0 inches.

7. The carton system of claim 6 wherein:

said first carton sidewall has a height of about 3.15 inches; and said second carton sidewall has a height of about 3.15 inches.

8. The carton system of claim 3 wherein:

said first carton first planar member and said first carton second planar member each have a generally rectangular shape with a front edge, a rear edge, a first lateral edge, and a second lateral edge; and said second carton first planar member and said second carton second planar member each have a generally rectangular shape with a front edge, a rear edge, a first lateral edge, and a second lateral edge; and each said first carton first planar member, first carton second planar member, said second carton first planar member, second carton second planar member being the generally the same size.

9. The carton system of claim 8 further comprising:

an outer carton having a generally rectangular top planar member, a generally rectangular bottom planar member, a front planar member, a rear planar member, a first lateral planar member and a second lateral planar member;

said top planar member and said bottom planar member disposed generally parallel to each other;

said front planar member, said rear planar member, said first lateral planar member and said second lateral planar member extending between, and generally perpendicular to, said top planar member and said bottom planar member;

wherein said outer carton top planar member and said outer carton bottom planar member have a slightly larger cross-sectional area than said first carton first planar member, first carton second planar member, said second carton first planar member, and second carton second planar member; and wherein when said first carton and said second carton are disposed in said outer carton, said first carton and said second carton are generally aligned with said first carton first planar member front edge and said second carton first planar member front edge being generally disposed in the same plane.

10. The carton system of claim 9 wherein:

said outer carton top planar member is removable;

said front planar member has a removable portion; and wherein, when said first carton and said second carton are disposed in said outer carton and when said outer carton top planar member and said front planar member removable portion are removed, said first carton and said second carton are visible within said outer carton.

11. The carton system of claim 10 wherein:

said first carton first planar member, said first carton second planar member and said first carton sidewall are formed from a single planar sheet of corrugated material; and said second carton first planar member, said second carton second planar member and said second carton sidewall are formed from a single planar sheet of corrugated material.

12. The carton system of claim 11 wherein each said frame assembly includes two elongated handle members, said handles having a length greater than a hopper, and wherein:

said first carton and said second carton enclosed space are each sized to enclose a pair of said wheelbarrow handle members, a wheel, a frame assembly and a set of coupling devices; and said first carton and said second carton enclosed space is so dimensioned to allow said a pair of handle members to be disposed immediately adjacent to a hopper rim portion.

13. The carton system of claim 12 wherein:

said first carton sidewall has a height of between about 2.5 inches and 5.0 inches; and said second carton sidewall has a height of between about 2.5 inches and 5.0 inches.

14. The carton system of claim 13 wherein:

said first carton sidewall has a height of about 3.15 inches; and said second carton sidewall has a height of about 3.15 inches.

* * * * *